US008950510B2

(12) United States Patent
Bender

(10) Patent No.: US 8,950,510 B2
(45) Date of Patent: Feb. 10, 2015

(54) DRILL CUTTINGS CONVEYANCE SYSTEMS

(71) Applicant: Beitzel Corporation, Grantsville, MD (US)

(72) Inventor: Shawn Bender, Accident, MD (US)

(73) Assignee: Beitzel Corporation, Grantsville, MD (US)

( * ) Notice: Subject to any disclaimer, the term of this patent is extended or adjusted under 35 U.S.C. 154(b) by 0 days.

(21) Appl. No.: 13/804,272

(22) Filed: Mar. 14, 2013

(65) Prior Publication Data

US 2013/0256037 A1 Oct. 3, 2013

Related U.S. Application Data

(60) Provisional application No. 61/618,872, filed on Apr. 2, 2012.

(51) Int. Cl.
*E21B 21/06* (2006.01)

(52) U.S. Cl.
CPC ..... *E21B 21/06* (2013.01)
USPC ..... 175/66; 175/88

(58) Field of Classification Search
USPC ..... 175/66, 206, 207, 217, 88; 414/326; 198/663, 658, 493, 494; 366/186, 297, 366/298, 300; 241/243
See application file for complete search history.

(56) References Cited

U.S. PATENT DOCUMENTS

| | | | | |
|---|---|---|---|---|
| 1,462,997 | A * | 7/1923 | Anderson | 299/56 |
| 2,048,569 | A * | 7/1936 | Johnson | 241/243 |
| 3,713,499 | A | 1/1973 | Arscott et al. | |
| 3,766,997 | A * | 10/1973 | Heilhecker et al. | 175/66 |
| 4,116,288 | A | 9/1978 | Love | |
| 4,168,035 | A * | 9/1979 | Palm et al. | 241/81 |
| 4,216,836 | A | 8/1980 | Rayborn | |
| 4,350,591 | A | 9/1982 | Lee | |
| 4,546,783 | A | 10/1985 | Lott | |
| 4,836,302 | A | 6/1989 | Heilhecker et al. | |
| 5,007,590 | A * | 4/1991 | Taylor | 241/25 |
| 5,109,933 | A | 5/1992 | Jackson | |
| 5,303,786 | A | 4/1994 | Prestridge et al. | |
| 5,454,957 | A | 10/1995 | Roff | |
| 5,639,035 | A * | 6/1997 | Maugle et al. | 241/236 |
| 6,110,367 | A | 8/2000 | Jensen et al. | |
| 6,276,824 | B1 | 8/2001 | De Jager | |
| 6,345,672 | B1 * | 2/2002 | Dietzen | 175/66 |
| 6,602,181 | B2 | 8/2003 | Quintero et al. | |
| 6,936,092 | B2 | 8/2005 | Seyffert et al. | |
| 6,988,567 | B2 | 1/2006 | Burnett et al. | |
| 7,093,678 | B2 | 8/2006 | Risher et al. | |

(Continued)

FOREIGN PATENT DOCUMENTS

EP 2547466 A2 1/2013

*Primary Examiner* — David Andrews
*Assistant Examiner* — Ronald Runyan
(74) *Attorney, Agent, or Firm* — The Webb Law Firm

(57) ABSTRACT

Embodiments relate generally to drill cuttings conveyance systems comprising a collection tank, a port, and a pump. The collection tank comprises a chamber operable to accommodate drill cuttings and a screw conveyor. The screw conveyor extends along a longitudinal axis of the collection tank from a first end of the chamber to a second end of the chamber. The port comprises a channel operable to direct drill cuttings from the chamber of the collection tank to the pump. The pump comprises an inlet operable to receive drill cuttings from the port, an outlet, and a pumping mechanism operable to direct drill cuttings through the outlet of the pump.

19 Claims, 8 Drawing Sheets

(56) References Cited

U.S. PATENT DOCUMENTS

| | | | | |
|---|---|---|---|---|
| 7,195,084 | B2 | 3/2007 | Burnett et al. | |
| 7,404,903 | B2 | 7/2008 | Bozak et al. | |
| 7,493,969 | B2 | 2/2009 | Burnett et al. | |
| 7,575,072 | B2 | 8/2009 | Reddoch, Sr. | |
| 8,276,686 | B2 | 10/2012 | James | |
| 2006/0124361 | A1 | 6/2006 | Mundell et al. | |
| 2008/0107553 | A1 | 5/2008 | Mundell | |
| 2008/0135300 | A1 | 6/2008 | James | |
| 2008/0179090 | A1 | 7/2008 | Eia et al. | |
| 2008/0251428 | A1 | 10/2008 | Bailey | |
| 2009/0110565 | A1* | 4/2009 | Parrett et al. | 417/203 |
| 2009/0227477 | A1 | 9/2009 | Burnett | |
| 2010/0047042 | A1 | 2/2010 | Templet, III | |
| 2010/0206383 | A1 | 8/2010 | Getliff et al. | |
| 2012/0073932 | A1 | 3/2012 | Burnett et al. | |
| 2012/0132504 | A1 | 5/2012 | Ardoin et al. | |

* cited by examiner

DRILL CUTTINGS CONVEYANCE SYSTEMS

CROSS-REFERENCE TO RELATED APPLICATIONS

The present application is filed under 35 U.S.C. §111(a) and, pursuant to 35 U.S.C. §119(e), claims the benefit of and priority to U.S. Provisional Application Ser. No. 61/618,872, filed Apr. 2, 2012, the entirety of which is hereby incorporated by reference.

TECHNICAL FIELD

The present specification generally relates to drill cuttings conveyance systems and, more particularly, to systems and methods for conveying drill cuttings generated from oil and natural gas drilling operations.

BACKGROUND

Drill fluid generally comprises one or more of hydrocarbons, water, salt, and other chemicals or substances and is widely used in oil and natural gas drilling operations. Drill fluid may provide subsurface pressure that aids in the prevention of underground fluids from entering the borehole, lubricates and cools the drill bit, and carries ground up earth (which may be generally referred to herein as drill cuttings solids), in suspension, back to the surface so that it does not interfere with drilling operations. Typically, drill fluid is injected from the surface during the drilling process down through an annular channel within the drill string. The drill fluid then exits the drill string through nozzles or apertures in the drill bit where it thereafter returns to the surface in the area between the drill string and the walls of the borehole, carrying with it the drill cuttings solids so that they are removed from the borehole.

It may be desirable to reuse the drill fluid for further drilling operations after it has been recovered from the borehole. In order to do so, and in order to facilitate the disposal or recycling of the drill cuttings solids, the solids generally must be separated, or substantially separated, from the drill fluid. The drill cuttings containing drill fluids and solids, once it arrives at the surface, generally is passed over one or more shaker screens, also called rig shakers or shale shakers, that may vibrate to aid in the separation of the solids from the drill fluid. Generally, as drill cuttings pass over the shaker screens, the drill fluid passes through the screens, while the solids are caught by the screens and directed to a collection or storage area. Often, however, the use of shaker screens alone is insufficient to remove enough drill fluid from the solids to allow for the solids' disposal. Therefore, additional processing of the drill cuttings may be necessary to further remove drill fluid therefrom. Processing equipment often includes a hydrocyclone, centrifuge, or other similar equipment that generally is operable to process the drill cuttings for further removal of drill fluid.

A number of augers often are used to channel drill cuttings to various stages of conventional systems. Augers generally are rigid, fixed in length, and limited to the degree they can be positioned at an incline. Thus, augers tend to require a large amount of space to direct drill cuttings through or to a processing system. Further, augers may be susceptible to clogging with drill cuttings having a high viscosity and, conversely, can have difficulty in directing, particularly at an incline, drill cuttings having a low viscosity. For these reasons, and given the tendency of drill cuttings solids to settle, augers generally are not configured to passively receive (i.e., receive while not in operation) drill cuttings. As a result, augers tend to be in constant operation in an attempt to prevent such settling and blockages. Also, due to the large amount of surface area on the flights of an auger, drill cuttings constantly are wearing down or eroding the auger, rendering it to what may be a short operating life.

In addition, conventional systems and methods often rely on the use of heavy machinery, such as excavators, to handle or transport drill cuttings at various stages thereof. For instance, excavators commonly are used to transfer drill cuttings from a tank or pit to a processing system for removal of drill fluid. Once the drill cuttings have been processed and drill fluid has been substantially removed therefrom, the remaining solids of the drill cuttings often are directed into another auger, holding tank, or pit until they ultimately are transferred once again with the aid of an excavator to a vehicle or a transportable container for transport. The use of heavy machinery to transfer drill cuttings from one place to another generally is inefficient as such transfers often are inconsistent and fail to provide a continuous conveyance of drib cuttings to the processing equipment. In addition, having heavy equipment, such as excavators, on site is a costly expense to drill operators and may be hazardous to the working crew.

SUMMARY

In accordance with one embodiment, a drill cuttings conveyance system. comprises a collection tank, a port, and a pump. The collection tank comprises a screw conveyor and a chamber operable to accommodate drill cuttings. The screw conveyor extends along a longitudinal axis of the collection tank from a first end of the chamber to a second end of the chamber. The port comprises a channel operable to direct drill cuttings from the chamber of the collection tank to the pump. The pump comprises an inlet operable to receive drill cuttings from the port, an outlet, and a pumping mechanism operable to direct drill cuttings through the outlet of the pump.

In accordance with another embodiment, a drill cuttings conveyance system comprises a collection tank, a port, and a pump. The collection tank comprises a chamber operable to accommodate drill cuttings, a screw conveyor, and an anvil. The screw conveyor extends along a longitudinal axis of the collection tank from a first end of the chamber to a second end of the chamber and is operable to rotate relative to the first end and the second end of the chamber and comprises a hammer. The anvil is positioned in the chamber relative to the hammer such that the anvil and the hammer are cooperatively operable to grind drill cuttings accommodated by the chamber with rotation of the screw conveyor. The port comprises a channel operable to direct drill cuttings from the chamber of the collection tank to the pump, The pump comprises an inlet operable to receive drill cuttings from the port, an outlet, and a pumping mechanism operable to direct drill cuttings through the outlet of the pump.

In accordance with another embodiment, a method of conveying drill cuttings comprises: providing a drill cuttings conveyance system comprising a collection tank, a port, a pump, discharge piping, and a processing platform, wherein the processing platform comprises an elevated base operable to support processing equipment above a surface at a minimum height sufficient for the processing equipment to deposit drill cuttings directly into a storage unit; accumulating drill cuttings in the collection tank; agitating the drill cuttings in the collection tank with one or more rotatable screw conveyors of the collection tank; directing the drill cuttings from the collection tank to the pump with the port; operating the pump to direct the drill cuttings through an outlet of the pump to the discharge piping; directing the drill cuttings through the discharge piping to the processing equipment supported by the processing platform; processing the drill cuttings with the processing equipment to remove fluid from the drill cuttings; and depositing the processed drill cuttings from the processing equipment into the storage unit.

These and additional features provided by the embodiments described herein will be more fully apparent and understood in view of the following detailed description, in conjunction with the drawings described below.

BRIEF DESCRIPTION OF THE DRAWINGS

The following detailed description of illustrative embodiments can be understood when read in conjunction with the following drawings, where like structure is indicated with like reference numerals and in which.

Figure 1:
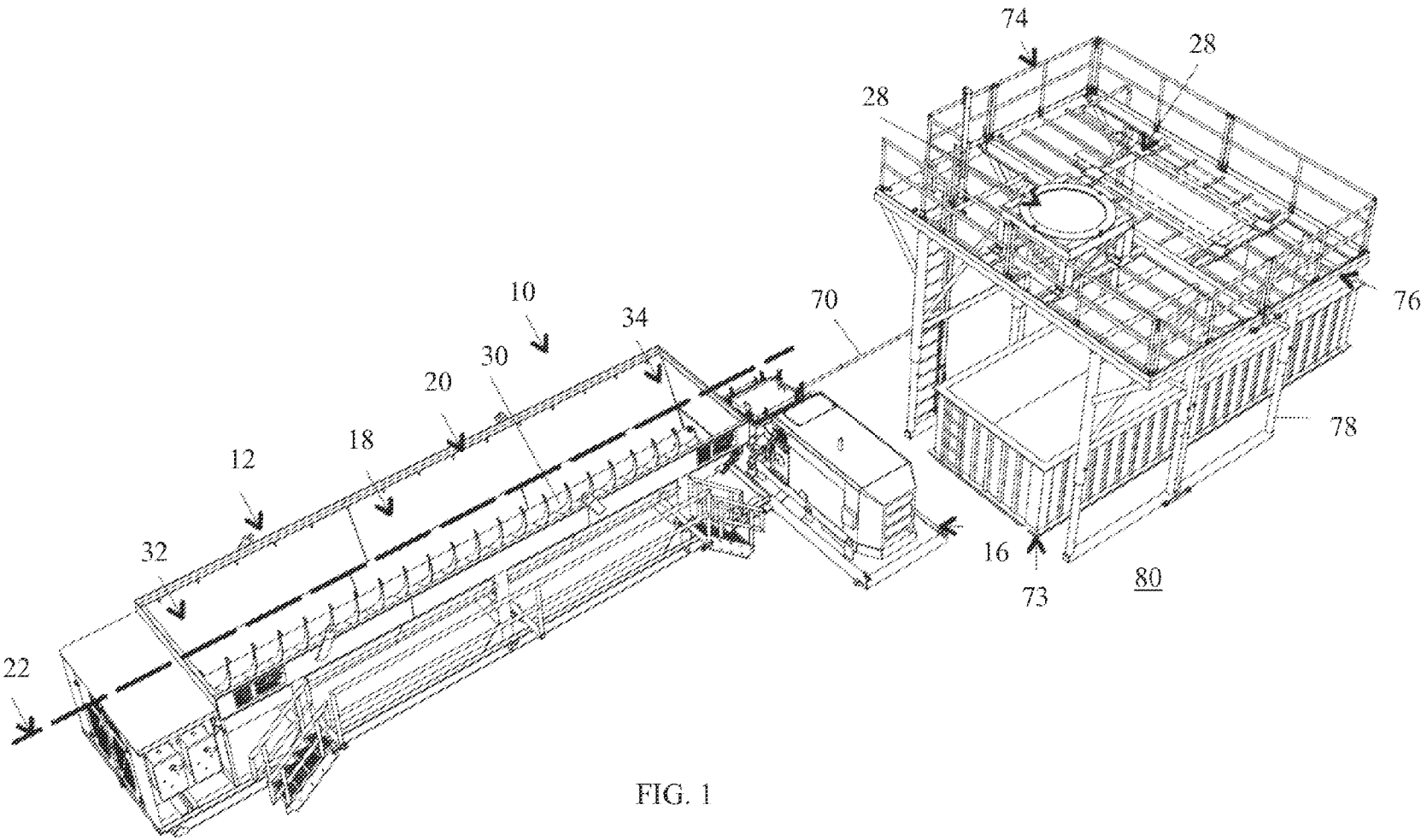
FIG. 1 is a perspective view of a drill cuttings conveyance system according to one or more embodiments.

The embodiments set forth in the drawings are illustrative in nature and are not intended to be limiting of the embodiments defined by the claims.

DETAILED DESCRIPTION

Embodiments described herein relate to drill cuttings conveyance systems and methods. As described herein, the conveyance systems and methods may be used to convey drill cuttings away from drill rig sites to processing equipment for removing drill fluid from the drill cuttings. Various embodiments of the drill cuttings conveyance systems, the operations thereof, and methods of conveying drill cuttings are described in more detail herein. As used herein, drill cuttings, unless described otherwise, refer generally to the drill fluid and the drill cuttings solids suspended therein that are returned to the surface from a borehole during oil and natural gas drilling operations. Also, as used herein, processed drill cuttings, unless described otherwise, refer generally to drill cuttings that have been processed by processing equipment such that drill cuttings solids have been separated, or substantially separated, from the drill fluid in which the solids had been suspended.

Figure 2A:
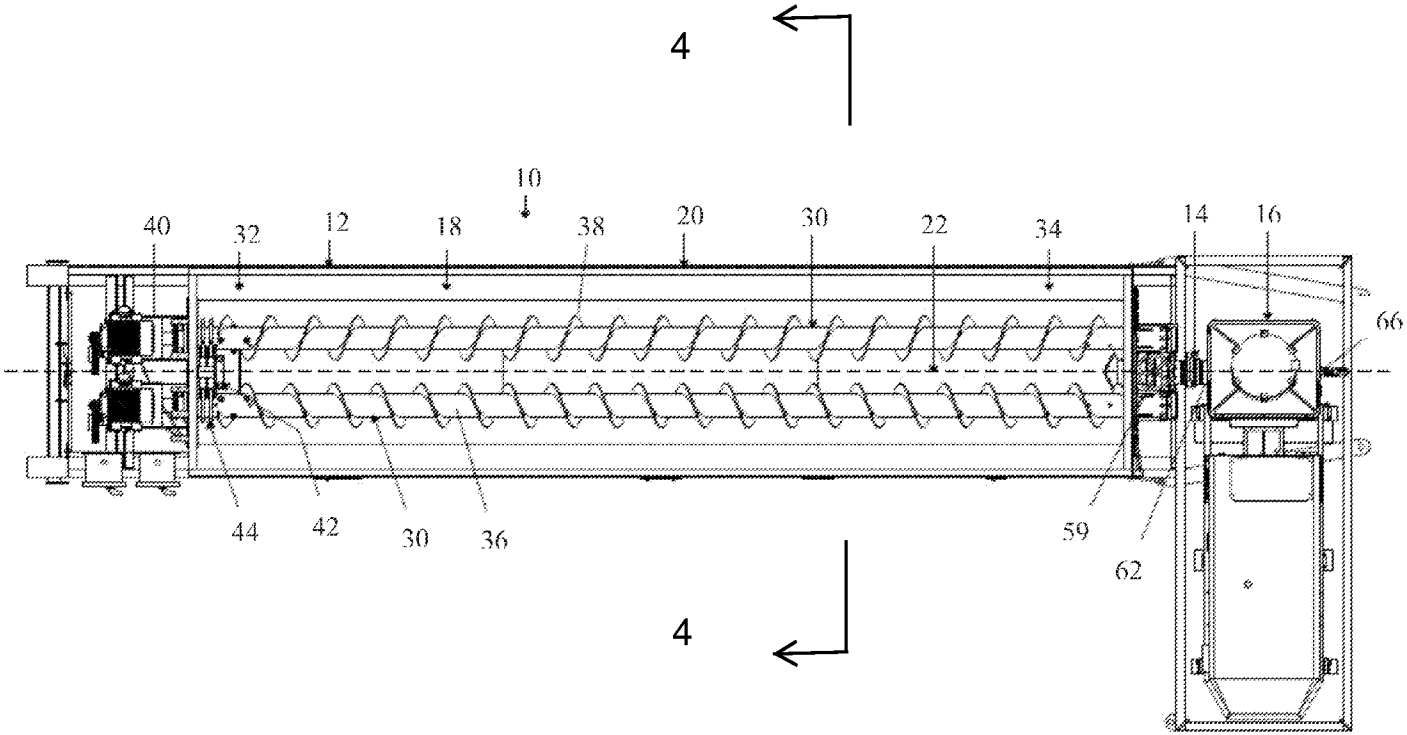
FIG. 2A is a top view of a drill cuttings conveyance system according to one or more embodiments.

Referring to FIG. 1, an embodiment of a drill cuttings conveyance system 10 comprises components operable to convey drill cuttings without any handling, with or minimal handling, thereof by a working crew or heavy machinery once the drill cuttings are introduced into the system, potentially through to a deposit of processed drill cuttings directly into a storage unit or transport vehicle by processing equipment. As shown in FIGS. 1 and 2A, the system 10 comprises a collection tank 12, a port 14, and a pump 16. The collection tank comprises a chamber 18 operable to accommodate drill cuttings. The collection tank 12 may be any tank having such a chamber operable to receive drill cuttings directly from a drill rig or from shaker screens or other initial processing stage for removal of drill fluid therefrom. It is contemplated that the drill cuttings may be directed into the chamber 18 of the collection tank 12 via any suitable input device operable to direct the drill cuttings therein. Generally, the collection tank 12 receives the drill cuttings after they have been processed over the shaker screen(s) described above. The system 10 may be configured such that the drill cuttings may be conveyed directly into the collection tank 12 from the shaker screen(s) or other initial processing device or the drill rig. For example, as shown in the embodiments of FIGS. 1 and 2A, the collection tank 12 may comprise an open top end 20, or a top end partially or entirely covered with one or more grates, such that drill cuttings may fall or otherwise proceed directly into the chamber 18 of the collection tank 12 as they leave the shaker screen(s). In other embodiments, the system 10 may further comprise one or more of a screw conveyor, a sliding floor, a rod and scraper, a paddle, a belt conveyor, a paddle auger, a piston, a rotating drum, a sliding wall, and a bucket elevator that, individually or cooperatively in any combination thereof, are operable to direct the drill cuttings into and/or out of the collection tank 12. It is further contemplated that embodiments of the system 10 may additionally or alternatively comprise one or more devices or assemblies utilizing one or more of vibration, gravity, dilution, air injection, liquid dilution, and liquid agitation that are operable to direct drill cuttings into and/or out of the collection tank 12.

Figure 3:
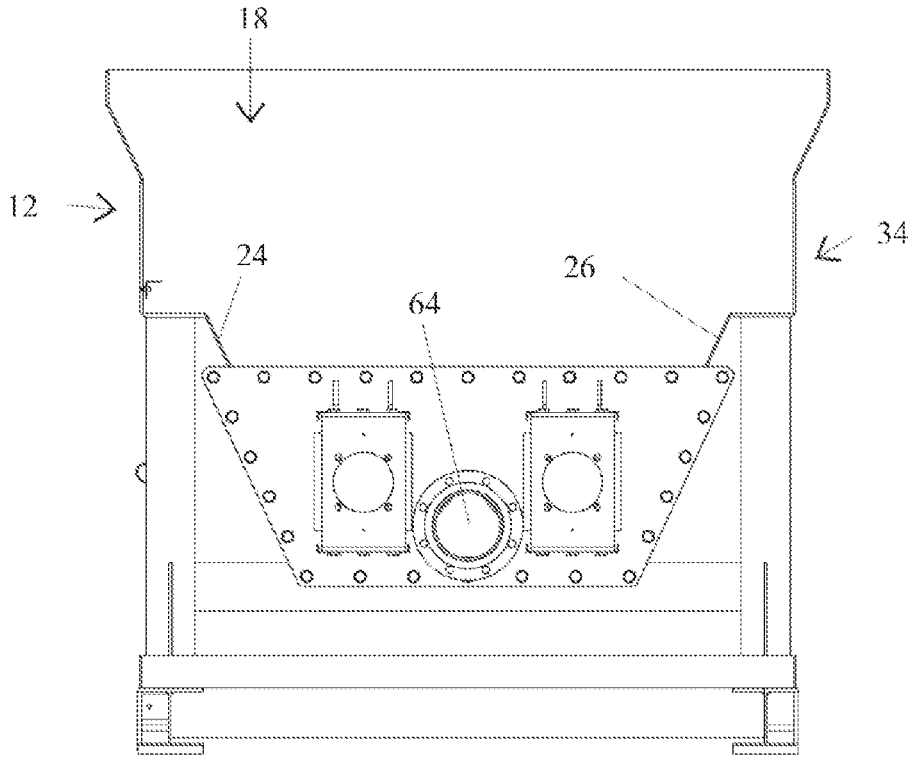
FIG. 3 is an end view of an embodiment of a collection tank for use with the drill cuttings conveyance system of FIG. 2A according to one or more embodiments.
Figure 4:
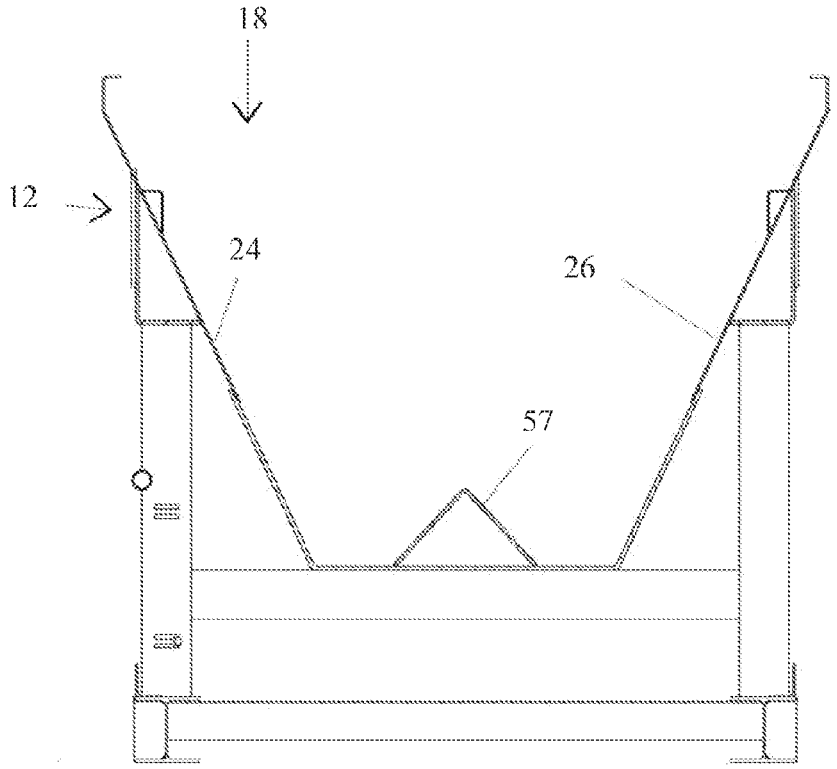
FIG. 4 is a cross-sectional view of the collection tank of FIG. 3 according to one or more embodiments.

The collection tank 12 and the chamber 18 thereof may be one of any variety of sizes and/or configurations sufficient to accommodate, and allow accumulation of, any desirable amount of drill cuttings. In one embodiment, shown in FIGS. 1 and 2A, the collection tank 12 comprises a longitudinal axis 22. FIGS. 3 and 4 further illustrate the inwardly sloping, from top to bottom, walls 24, 26 of the embodiment of the collection tank 12 shown in FIGS 1 and 2A.

The collection tank 12 may passively receive and accommodate accumulating drill cuttings for significant durations, which may reduce the overall time necessary for system 10 operation and/or drill cuttings processing by processing equipment. For example, in one embodiment, the collection tank 12 is sized to receive and accommodate up to about 400 barrels of drill cuttings. Such an embodiment has the potential to eliminate the need for working crews to be on hand on a 24 hour basis. Further, such an embodiment offers reserve capacity for accommodating drill cuttings in the collection tank 12 during periods when the system 10 is not in operation, but drilling operations continue. More particularly, the operability of the collection tank 12 to passively receive and accommodate drill cuttings enables continued operations of a drill rig while the system 10 and/or drill cuttings processing equipment 28 are shut down.

The collection tank 12 also may be configured to allow for the adjustment of the viscosity of the drill cuttings accommodated by the chamber 18 of the collection tank 12 as it is believed that the viscosity of the drill cuttings may impact the removal of drill fluid from the drill cuttings by processing equipment 28. More particularly, it is believed that too high of a viscosity of the drill cuttings in may hinder the ability of processing equipment 28 to which the conveyance system 10 may direct drill cuttings to remove drill fluid from the drill cuttings. Therefore, embodiments of the system 10 may further comprise a fluid input operable to direct fluid into the chamber 18 of the collection tank 12 to lower the viscosity of the drill cuttings held therein. Fluid inputted into the chamber 18 may be, for example, drill cuttings having a low viscosity, drill fluid, or water. Additionally, or alternatively, the system 10 may comprise a secondary pump or a drain provided in or to the collection tank 12 for pumping off or otherwise removing drill fluid from the drill cuttings accommodated by the chamber 18. For example, in one embodiment, the collection tank 12 comprises a sump pump that is operable to pump fluid out of the tank 12. The sump pump and/or the collection tank 12 may comprise a screen to substantially allow only fluid drawn from the drill cuttings to enter the sump pump so that substantially only fluid is pumped out of the collection tank 12.

The collection tank 12 further comprises one or more blenders or mixers, or other similar devices, operable to blend, mix, or agitate drill cuttings to provide a uniform, or substantially uniform, viscosity to the drill cuttings accommodated by the chamber 18. For instance, with passive receipt and accumulation of drill cuttings in the chamber 18 while the system 10 is not in operation, solids of the drill cuttings may settle from drill fluid to the bottom of the chamber 18. Such settling may result in formation of phases within the drill cuttings having differing viscosities. It is believed that drill cuttings having inconsistent viscosity levels that are provided to processing equipment may result in inconsistent and inefficient processing of the drill cuttings such that processed drill cuttings may have varying amounts of drill fluid remaining entrained with the solids. Processing equipment is believed to operate most effectively and efficiently when drill cuttings having a uniform, or substantially uniform, viscosity are provided to the equipment for processing. Blending, mixing, or agitating the drill cuttings in the chamber thus may provide a more uniform viscosity level to the drill cuttings and facilitate the processing thereof by processing equipment.

Figure 5A:
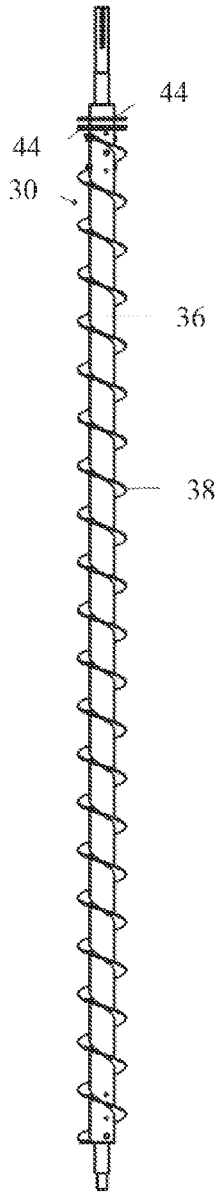
FIG. 5A is a side view of an embodiment of a screw conveyor for use with the drill cuttings conveyance system of FIG. 2A according to one or more embodiments.
Figure 5B:
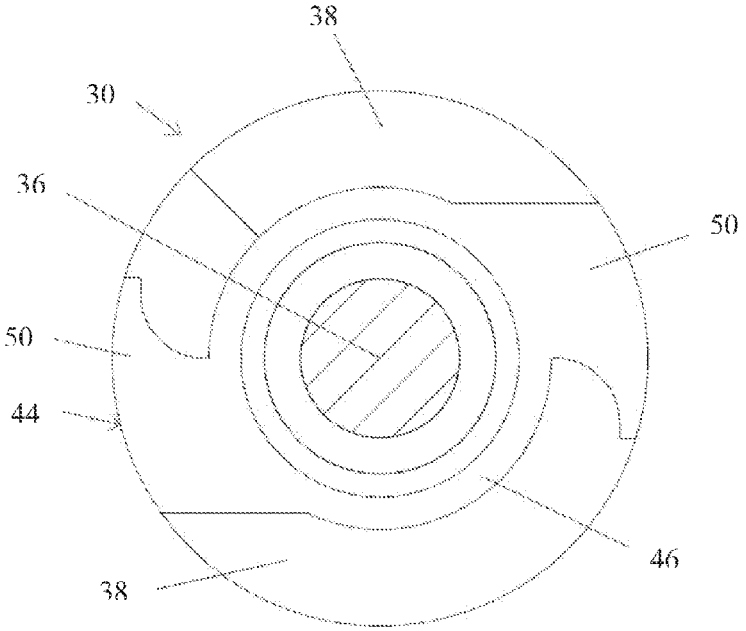
FIG. 5B is an end view of the screw conveyor of FIG. 5A according to one or more embodiments.

In the embodiment shown in FIG. 2A, the collection tank 12 comprises one or more screw conveyors 30. The screw conveyors 30 extend along the longitudinal axis 22 of the collection tank 12 from a first end 32 of the chamber 18 to a second end 34 of the chamber 18. As shown in FIGS. 2A, 5A, and 5B, each screw conveyor 30 generally comprises a shaft 36 and a flange 38 helically extending from a length of the shaft 36. The screw conveyors 30 generally are operable to rotate bi-directionally relative to the first end 32 of the chamber 18 and the second end 34 of the chamber 18 and to agitate drill cuttings accommodated by the chamber 18 with rotation. In one particular embodiment, shown in FIG. 2A, the collection tank 12 comprises two bi-directionally rotatable screw conveyors 30 that extend, in parallel, along the longitudinal axis 22 of the collection tank 12. Two or more screw conveyors 30 arranged in this manner in the chamber 18 may, with rotation, facilitate the agitation of drill cuttings for a more uniform viscosity thereof and the conveyance of the drill cuttings to the pump 16, particularly those that have been passively received by and accumulated in the chamber 18 for some time without operation of the system 10 that, with settling, can compact, or substantially compact, at the bottom of the chamber 18. To impart rotation to the screw conveyors, the system 10 may further comprise a drive motor 40, as shown in FIG. 2A, coupled to an end of the screw conveyor 30.

To facilitate agitation of drill cuttings in the chamber 18 and the provision of a uniform, or substantially uniform, viscosity to the drill cuttings, the system 10 may further comprise an anvil 42. In such an embodiment, one or more of the screw conveyors 30 of the system 10 respectively may comprise one or more hammers 44 that may interact with the anvil 42 to grind or break down solids of the drill cuttings. The hammers 44 may extend from the shaft 36 of the screw conveyor 30 such that the hammers 44 rotate with rotation of the screw conveyor 30 from which they extend. The anvil 42 is positioned in the chamber 18 relative to the hammers 44 such that the anvil 42 and the hammers 44 are cooperatively operable to grind solids of the drill cuttings with rotation of the screw conveyors 30 and the hammers 44.

Figure 5C:
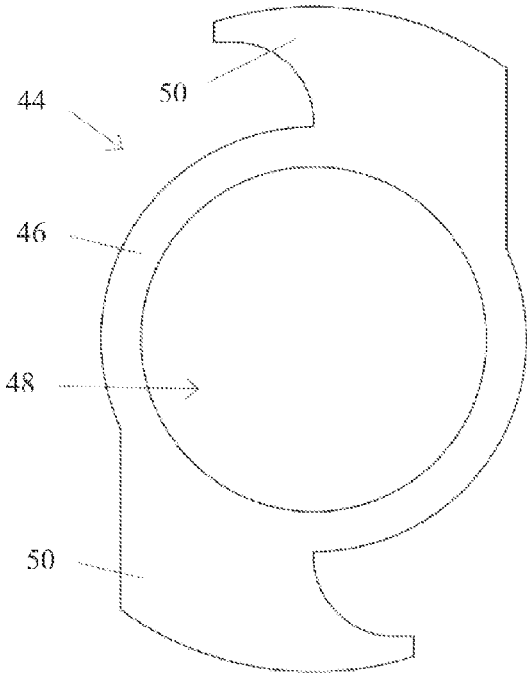
FIG. 5C is an isolated view of a hammer of the screw conveyor of FIGS. 5A and 5B for use with the drill cuttings conveyance system of FIG. 2A according to one or more embodiments.

More particularly, for example, in one embodiment, shown in FIGS. 5A, 5B, and 5C, a hammer 44 comprises a body 46 and a channel 48 there-through that is sized to accommodate the shaft 36 of the screw conveyor 30 so that the hammer 44 may extend therefrom. The hammer 44 also comprises one or more extensions 50 that project from the body 46. The extensions 50 may be spaced about a perimeter of the body 46 and are operable to capture drill cuttings solids for rotation with the hammer 44 toward the anvil 42. Additionally, in one embodiment shown in FIGS, 7A, 7B, and 7C, the anvil 42 comprises two or more heads 52 and one or more channels 54 positioned between and separating the heads 52. The heads 52 are supported by a base 56 that may secure the anvil 42 directly to a wall of the collection tank 12 that defines the chamber 18. The anvil 42 generally is positioned in the chamber 18 relative to the hammer 44 such that, with rotation of the screw conveyor 30 and the hammer 44, the extensions 50 of the hammer 44 pass through the channels 54, and between the heads 52, of the anvil 42. In one embodiment, the heads 52 of the anvil 42 interact with the rotating extensions 50 of the hammers 44 at a tolerance of not more than about one-half of an inch with passage of the extensions 50 through the channels 54 of the anvil 42. Thereby, drill cuttings solids captured by the extensions 50 of the hammer 44 with rotation thereof may be ground or broken up by the interaction between the extensions 50 and the anvil heads 52. It is contemplated that the anvil 42 and the hammer 44 may be configured to interact at a tolerance other than about one-half of an inch, greater or lessor, sufficient to grind or break up drill cuttings solids as described herein. Further, as shown in FIG. 2A, the anvil 42 and the hammer 44 may be located at or near an end of the collection tank 12 nearest the drive motors 40 and farthest from the port 14 such that rotation of the screw conveyors 30 in a reverse direction of rotation directs the drill cuttings toward the anvil 42 and the hammer 44 for grinding and breaking down solids therein. It is contemplated that the anvil 42 may be removed from the chamber 18 when grinding or breaking down of drill cuttings solids is not needed or desirable.

The collection tank 12 also may comprise one or more baffles 57 positioned in the chamber 18, as shown in FIG. 4.

Figure 2B:
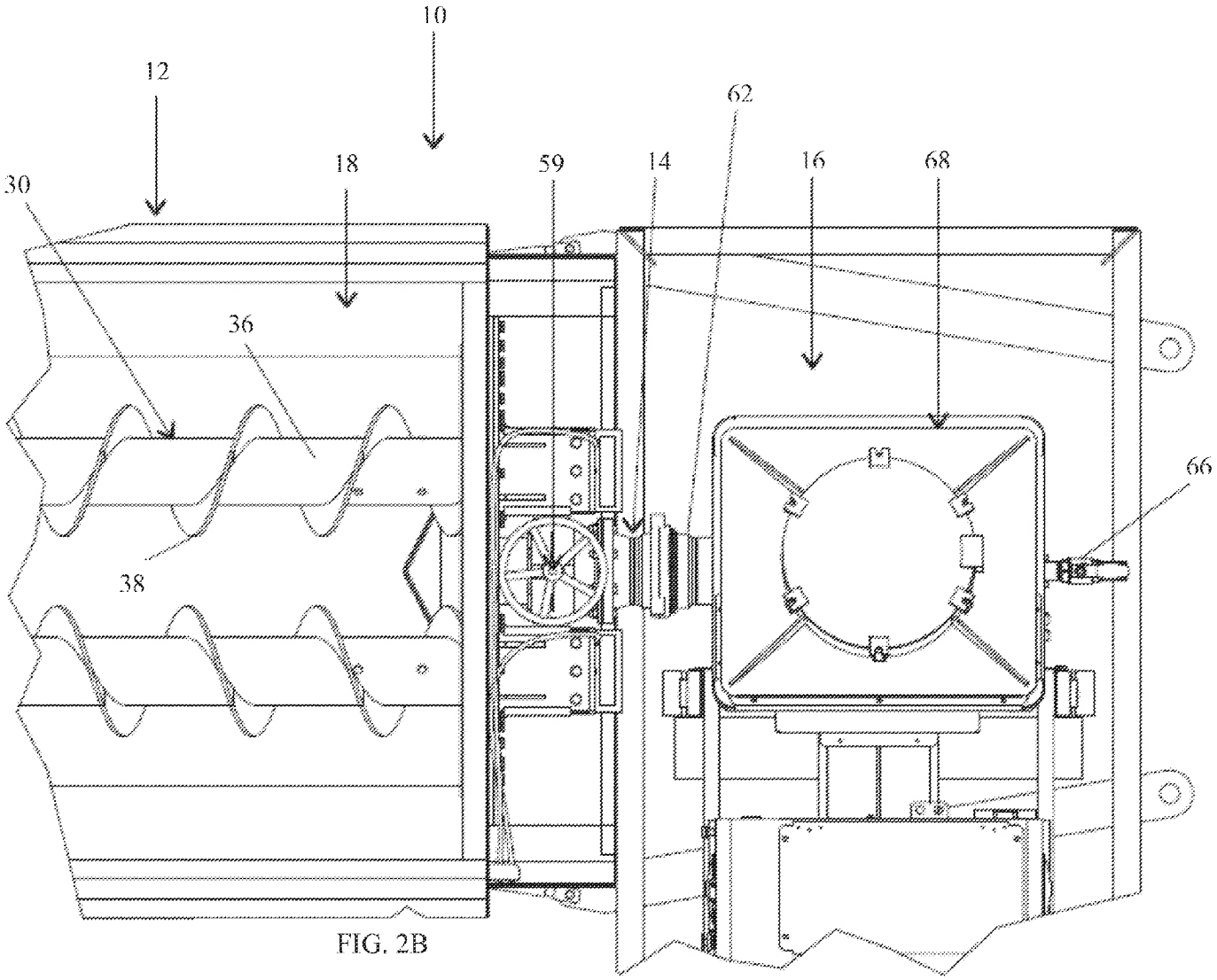
FIG. 2B a magnified top view of a portion of the drill cuttings conveyance system of FIG. 2A according to one or more embodiments.

The baffles 57 are operable to facilitate agitation of the drill cuttings with rotation of the screw conveyors 30 by directing a flow of drill cuttings toward the screw conveyors 30. Additionally, or alternatively, as shown in FIG. 2B, the collection tank 12 may comprise a valve assembly 59 operable to open or close, partially or entirety, passage of drill cuttings from the chamber 18 to the port 14.

Figure 6A:
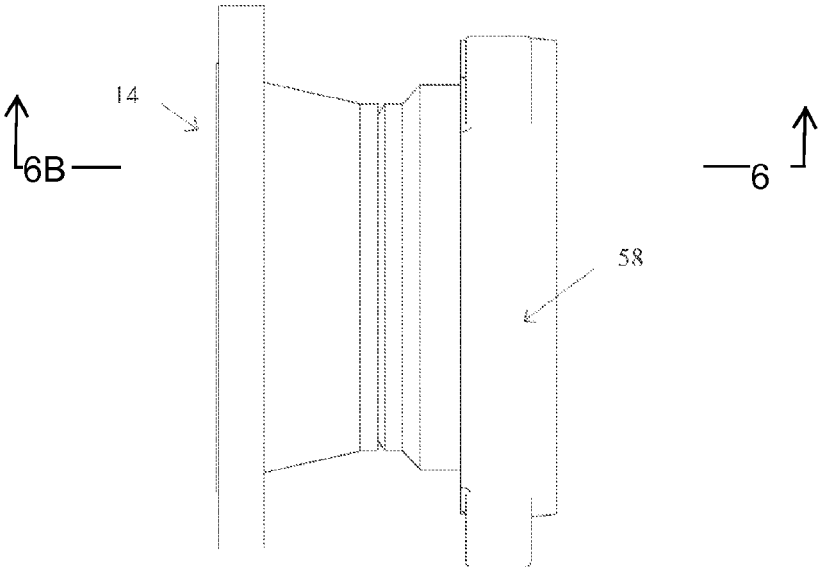
FIG. 6A is a side view of an embodiment of a port for use with the drill cuttings conveyance system of FIG. 2A according to one or more embodiments.
Figure 6B:
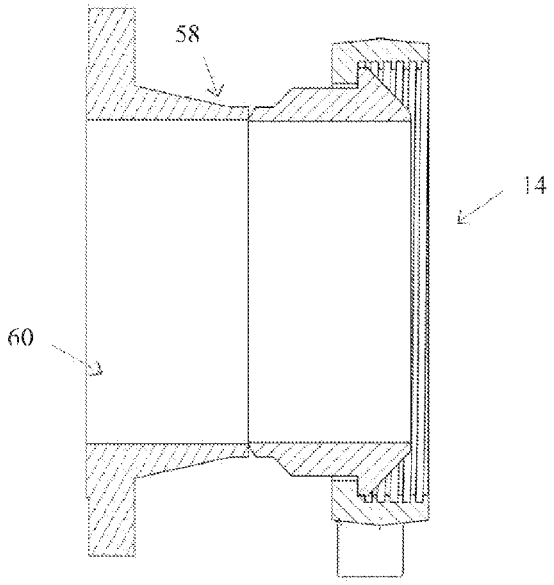
FIG. 6B is a cross-sectional view of the port of FIG. 6A according to one or more embodiments.
Figure 7A:
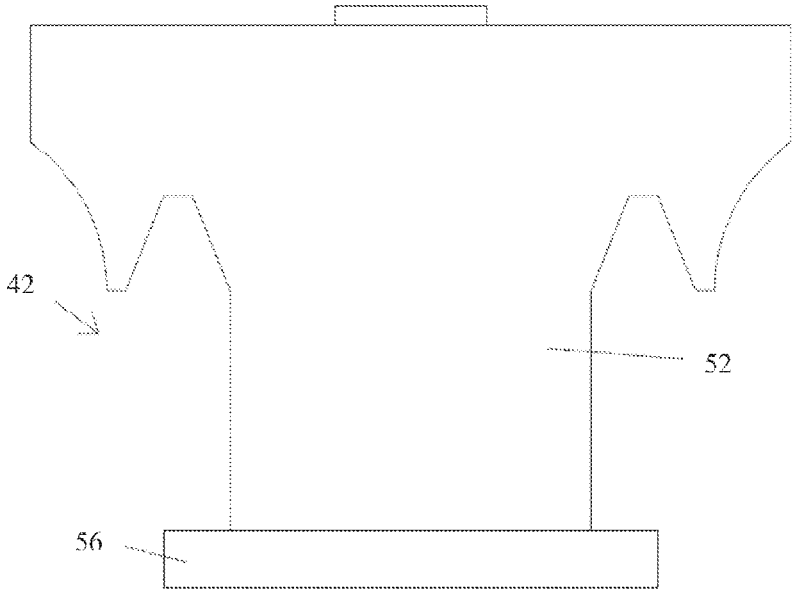
FIG. 7A is a side view of an embodiment of an anvil for use with the drill cuttings conveyance system of FIG. 2A according to one or more embodiments.
Figure 7B:
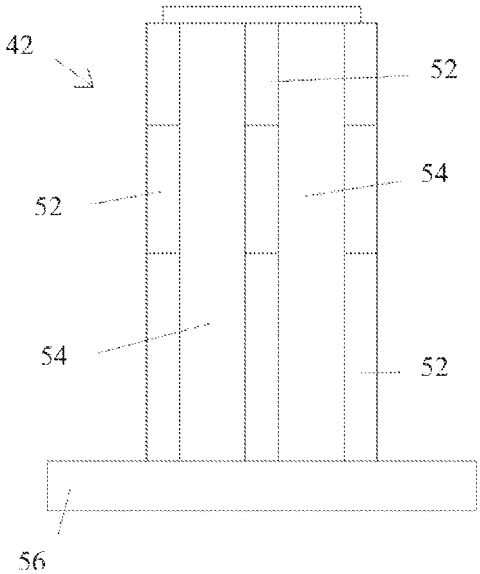
FIG. 7B is another side view of the anvil of FIG. 7A according to one or more embodiments.
Figure 7C:
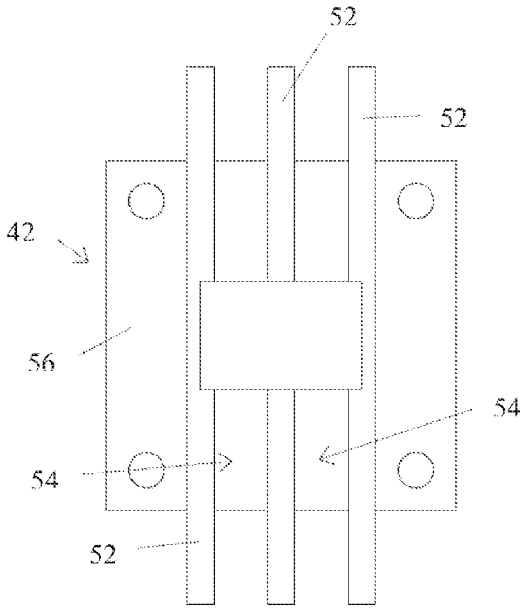
FIG. 7C is a top view of the anvil of FIGS. 7A and 7B according to one or more embodiments.

Following agitating and grinding, if either or any, of the drill cuttings in the chamber 18, drill cuttings may be permitted passage through the port 14 for conveyance by the system 10. More particularly, as shown in FIGS. 6A and 6B, the port 14 may comprise a body 58 and a channel 60 passing therethrough. The body 58 of the port 14 is configured to couple to the collection tank 12 and an input 62 of the pump 16. When so coupled, as shown in FIG. 2A, the channel 60 of the port 14 provides a passage for, and directs, drill cuttings from the chamber 18, through an opening 64 in a wall of the collection tank 12 (shown in FIG. 3), and into the pump input 62.

In one embodiment, the channel 60 of the port 14 comprises a diameter of between about four inches and about sixteen inches; whereas, in another embodiment, the channel 60 comprises a diameter of between about six inches and about ten inches; and whereas, in another embodiment, the channel 60 of the port 14 comprises a diameter of about eight inches. It is believed and contemplated by the present inventor that a combination of the size of the port channel 60 and a viscosity of the drill cuttings accommodated by the chamber 18 may determine whether the drill cuttings are permitted passage through the channel of the port 14 and into the pump 16.

The pump 16, as described above, comprises an inlet 62 operable to receive drill cuttings from the port 14. The pump 16 also comprises an outlet 66 and a pumping mechanism 68 operable to direct the drill cuttings through the outlet 66. The pump 16 may be one of any variety of pumps operable or configured to perform in a manner as described herein. For example, in one embodiment, the pump comprises a hydraulically driven piston pump. The piston pump may have an infinitely variable rate adjustable to convey drill cuttings through the system 10 and to processing equipment, or elsewhere, at a desirable rate and may be stopped altogether, ceasing conveyance of drill cuttings by the system 10. For example, but not by way of limitation, the pump 16 may direct drill cuttings through its outlet 66 at a rate of between about zero barrels per hour and about 190 barrels per hour or, more particularly, at a rate of between about 80 barrels per hour and about 120 barrels per hour, The ability of the pump to provide a consistent, although variable, conveyance of drill cuttings to processing equipment facilitates consistent and continuous operation of the system 10 and the processing equipment on an as needed basis.

Figure 8A:
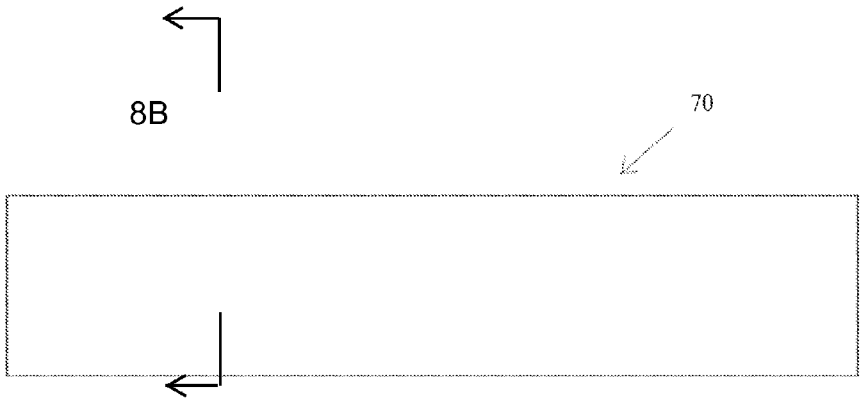
FIG. 8A is a side view of an embodiment of discharge piping for use with the drill cuttings conveyance system of FIG. 1 according to one or more embodiments.
Figure 8B:
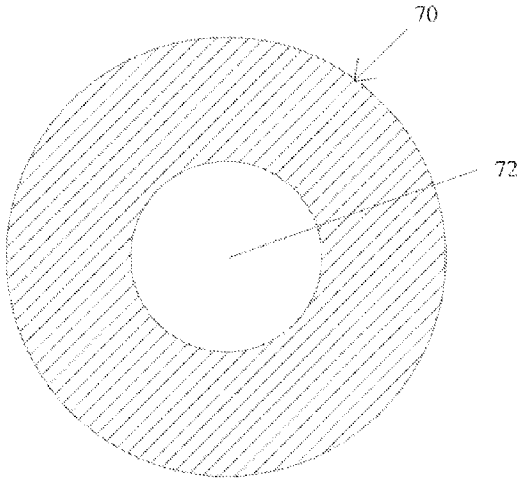
FIG. 8B is a cross-sectional view of the discharge piping of FIG. 8A according to one or more embodiments.

As shown in FIGS.1 and 8A, the system 10 may further comprise discharge piping 70 that may be configured to couple to the outlet 66 of the pump 16 and operable to direct drill cuttings from the pump 16 to processing equipment or elsewhere. The discharge piping 70 may comprise a channel 72 (shown in FIG. 8B) that may be sized to maintain, in coordination with the rate of the pump 16, a flow velocity of drill cuttings through the channel 72 of between about one foot per second and about nine feet per second, or more particularly, at a flow velocity of between about three feet per second and about seven feet per second. For example, but not by way of limitation, the channel 72 of the discharge piping 70 may comprise a diameter of between about one inch and about six inches and, in one embodiment, comprises a diameter of about two inches.

The discharge piping 70 may comprise piping, hoses, or other flexible or rigid conduit devices, or any combination thereof, that may be operable to direct drill cuttings to a variety of distances in any number of directions to wherever processing equipment for a storage unit 73) may be positioned, without the need for augers. For example, but not by way of limitation, the discharge piping 70, with the aid of the pump 16, may be operable to direct drill cuttings as far as about 500 feet laterally, or substantially laterally, and/or as high as about 100 feet vertically or substantially vertically. Such operability of the discharge piping 70 and the pump 16 enables the elevation of processing equipment above a surface to which drill cuttings may be conveyed by the system 10.

As shown in FIG. 1, the system 10 may further comprise a processing platform 74. The processing platform 74 may comprise a base 76 elevated by one or more legs 78 above a surface 80 at a minimum height and operable to support the processing equipment 28. The elevation of the base 76 above the surface 80 to the minimum height is at least sufficient for positioning of a storage unit 73 supported by a vehicle beneath, or at least partially beneath, the base 76 and processing equipment supported thereon for immediate transport of the processed drill cuttings. Thereby, base-supported processing equipment, through the use of a chute or other similar device or configuration of the processing equipment, may deposit processed drill cuttings directly into the storage unit 73 positioned there-beneath, as shown in FIG. 1.

It is contemplated that the storage unit 73 may be part of or supported by a vehicle or may be bins suitable for transportation, thereby eliminating any need for use of heavy machinery, such as excavators, to handle the drill cuttings following processing. Further, using an embodiment of the system 10 described herein and elevating the processing equipment with the processing platform 74 can reduce the overall footprint needed to complete conveyance and processing of drill cuttings.

Further, in an embodiment in which the system 10 comprises a processing platform 74, the system 10 may further comprise a slide rail system, or other similar system, operable to move the base 76 of the processing platform 74 along or about an elevated plane relative to the legs 78 of the platform 74. Thereby, lateral movement of the base 76 on the elevated plane may facilitate substantially equal distribution of drill cuttings into a storage unit 73 by the elevated processing equipment 28. In such an embodiment, it is contemplated that the discharge piping 70 may comprise a degree of flexibility sufficient to direct drill cuttings from the pump 16 to the elevated processing equipment while accommodating the mobility of the equipment on the elevated plane.

It is further contemplated that the system 10 may further comprise secondary discharge piping configured to couple to a discharge port of the processing equipment 28 and operable to direct drill fluid removed from the drill cuttings by the processing equipment 28 to a holding tank for drill fluid. There, the drill fluid may be directed for reintroduction into the borehole during drilling operations. For this reason, it is contemplated that an embodiment of the system 10 may also comprise one or more holding tanks operable to contain drill fluid and/or additional discharge piping operable to direct drill fluid from the holding tanks to a drill rig for drilling operations.

Additional embodiments relate generally to methods of conveying drill cuttings. In one such embodiment, a method comprises: providing a drill cuttings conveyance system comprising a collection tank, a port, a pump, discharge piping, and a processing platform, wherein the processing platform comprises an elevated base operable to support processing equipment above a surface at a minimum height sufficient for the processing equipment to deposit drill cuttings directly into a. storage unit; accumulating drill cuttings in the collection tank; agitating the drill cuttings in the collection tank with one or more rotatable screw conveyors of the collection tank; directing the drill cuttings from the collection tank to the pump with the port; operating the pump to direct the drill cuttings through an outlet of the pump to the discharge piping; directing the drill cuttings through the discharge piping to the processing equipment supported by the processing platform; processing the drill cuttings with the processing equipment to remove fluid from the drill cuttings; and depositing the processed drill cuttings directly from the processing equipment into the storage unit.

In one embodiment, one or more of the screw conveyors comprises a hammer and the method further comprises grinding the drill cuttings in the collection tank with an anvil of the collection tank and the hammer of one or more the screw conveyors, the anvil positioned in the collection tank relative to the hammer such that the anvil and the hammer cooperatively grind drill cuttings with rotation of the one or more screw conveyors. Further, in one embodiment, the drill cuttings are directed through the discharge piping to the processing equipment supported by the processing platform at a flow velocity of between about one foot per second and about nine feet per second.

It is noted that recitations herein of a. component of an embodiment being "operable" or "configured" in a particular way or to embody a particular property, or function in a particular manner, are structural recitations as opposed to recitations of intended use More specifically, the references herein to the manner in which a component is "operable" or "configured" denotes an existing physical condition of the component and, as such, is to be taken as a definite recitation of the structural characteristics of the component.

It is noted that terms like "generally" and "typically," when utilized herein, are not utilized to limit the scope of the claimed embodiments or to imply that certain features are critical, essential, or even important to the structure or function of the claimed embodiments. Rather, these terms are merely intended to identify particular aspects of an embodiment or to emphasize alternative or additional features that may or may not be utilized in a particular embodiment.

For the purposes of describing and defining embodiments herein it is noted that the terms "substantially," "approximately," and "about" may be utilized herein to represent the inherent degree of uncertainty that may be attributed to any quantitative comparison, value, measurement, or other representation. These terms also are utilized herein to represent the degree by which a quantitative representation may vary from a stated reference without resulting in a change in the basic function of the subject matter at issue. Additionally, throughout the specification, including the claims, of this application, the use of singular terminology encompasses the plural of the same unless it is clear that the context in which a singular terminology is used requires otherwise.

Having described and illustrated particular embodiments herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A drill cuttings conveyance system, comprising:

a collection tank comprising a screw conveyor and a chamber operable to accommodate drill cuttings, the screw conveyor extending along a longitudinal axis of the collection tank from a first end of the chamber to a second end of the chamber;

a port disposed at the second end of the chamber of the collection tank, the port comprising a channel Operable to direct the drill cuttings from the chamber of the collection tank;

a pump comprising an inlet connected to the port and operable to receive the drill cuttings from the port, an outlet, and a pumping mechanism operable to direct the drill cuttings through the outlet of the pump;

a processing platform comprising a base and one or more legs that elevate the base above a surface to a minimum height sufficient for removably positioning a storage unit in an area under the base; and processing equipment for processing the drill cuttings, the processing equipment being disposed on the base of the processing platform, wherein the base of the processing platform is elevated with respect to the port and the pump is operable to direct the drill cuttings from the port to the processing equipment on the processing platform, and wherein the processing equipment on the platform is operable to direct solid portions of the drill cuttings removed from drill fluid portions of the drill cuttings to the area under the base where the storage unit may be removably positioned, wherein the screw conveyor comprises a hammer disposed thereon and the collection tank further comprises an anvil disposed within the chamber, the anvil is positioned in the chamber relative to the hammer such that the anvil and the hammer are cooperatively operable to grind drill cuttings accommodated by the chamber with rotation of the screw conveyor, and wherein the hammer and anvil are positioned within the chamber spaced away from the port such that the drill cuttings may be ground without being directed from the chamber to the port.

2. The system of claim 1, wherein the screw conveyor comprises a shaft and a flange helically extending from a length of the shaft and is operable to rotate bi-directionally relative to the first end and the second end of the chamber and to agitate the drill cuttings accommodated by the chamber with rotation.

3. The system of claim 2, wherein the system further comprises a drive motor coupled to an end of the screw conveyor for imparting rotation to the screw conveyor.

4. The system of claim 1, wherein the collection tank comprises two rotatable screw conveyors that extend, in parallel, along the longitudinal axis of the collection tank.

5. The system of claim 1, wherein the channel of the port comprises a diameter of between about four inches and about sixteen inches.

6. The system of claim 5, wherein the channel of the port comprises a diameter of about eight inches.

7. The system of claim 1, wherein the system further comprises discharge piping coupled to the outlet of the pump and operable to direct the drill cuttings to the processing equipment.

8. The system of claim 7, wherein the discharge piping comprises a channel sized to maintain a flow velocity of the drill cuttings of between about one foot per second and about nine feet per second.

9. The system of claim 8, wherein the channel of the discharge piping comprises a diameter of between about one inch and about six inches.

10. The system of claim 9, wherein the channel of the discharge piping comprises a diameter of about two inches.

11. A drill cuttings conveyance system, comprising:

a collection tank having a longitudinal axis, the collection tank comprising:

a chamber operable to accommodate drill cuttings, the chamber having a first end and a second end;

a screw conveyor disposed within the chamber and extending along the longitudinal axis of the collection tank from the first end of the chamber to the second end of the chamber, the screw conveyor including a hammer; and an anvil disposed within the chamber;

a port disposed at the second end of the chamber of the collection tank, the port comprising a channel operable to direct the drill cuttings from the chamber of the collection tank; and a pump comprising an inlet connected to the port and operable to receive the drill cuttings from the port, an outlet, and a pumping mechanism operable to direct the drill cuttings through the outlet of the pump, wherein the anvil is positioned in the chamber relative to the hammer such that the anvil and the hammer are cooperatively operable to grind drill cuttings accommodated by the chamber with rotation of the screw conveyor, and wherein the hammer and anvil are positioned within the chamber spaced away from the port such that the drill cuttings may be ground without being directed from the chamber to the port.

12. The system of claim 11, wherein the channel of the port comprises a diameter of between about four inches and about sixteen inches.

13. The system of claim 12, wherein the channel of the port comprises a diameter of about eight inches.

14. The system of claim 11, wherein the anvil comprises two heads and a channel positioned between the two heads.

15. The system of claim 14, wherein the anvil is positioned in the chamber relative to the hammer such that, with rotation of the screw conveyor, the hammer passes through the channel of the anvil and between the two heads of the anvil.

16. The system of claim 11, wherein the hammer and anvil are positioned at the first end of the chamber of the collection tank.

17. The system of claim 11, wherein the screw conveyor, the hammer, and the anvil are configured to continuously grind the drill cuttings with none of the drill cuttings being directed from the chamber of the collection tank via the port.

18. A method of conveying drill cuttings, the method comprising:

providing a drill cuttings conveyance system, comprising:

a collection tank comprising a screw conveyor and a chamber operable to accommodate drill cuttings, the screw conveyor extending along a longitudinal axis of the collection tank from a first end of the chamber to a second end of the chamber;

a port disposed at the second end of the chamber of the collection tank, the port comprising a channel operable to direct the drill cuttings from the chamber of the collection tank;

a pump comprising an inlet connected to the port and operable to receive the drill cuttings from the port, an outlet, and a pumping mechanism operable to direct the drill cuttings through the outlet of the pump;

discharge piping;

a processing platform comprising a base and one or more legs that elevate the base above a surface; and processing equipment for processing the drill cuttings, the processing equipment being disposed on the base of the processing platform, wherein the base of the processing platform is elevated with respect to the port;

accumulating drill cuttings in the chamber of the collection tank;

agitating the drill cuttings in the chamber of the collection tank with the screw conveyor;

directing the drill cuttings from the chamber of the collection tank to the pump via the port;

operating the pump to direct the drill cuttings through the outlet of the pump to the discharge piping;

directing the drill cuttings through the discharge piping to the processing equipment disposed on the base of the processing platform;

processing the drill cuttings with the processing equipment to remove fluid from the drill cuttings;

removably positioning a storage unit on the surface underneath the base of the processing platform; and depositing by gravity feed the processed drill cuttings directly from the processing equipment into the storage unit, wherein the screw conveyor comprises a hammer and the method further comprises grinding the drill cuttings in the collection tank with an anvil of the collection tank and the hammer of the screw conveyor, the anvil is positioned in the collection tank relative to the hammer such that the anvil and the hammer cooperatively grind drill cuttings with rotation of the screw conveyor, and the hammer and the anvil are positioned away from the port such that the grinding step can be performed without the drill cuttings being directed to the pump via the port.

19. The method of claim 18, wherein the drill cuttings are directed through the discharge piping to the processing equipment supported by the processing platform at a flow velocity of between about one foot per second and about nine feet per second.

* * * * *

UNITED STATES PATENT AND TRADEMARK OFFICE

CERTIFICATE OF CORRECTION

PATENT NO. : 8,950,510 B2
APPLICATION NO. : 13/804272
DATED : February 10, 2015
INVENTOR(S) : Shawn Bender It is certified that error appears in the above-identified patent and that said Letters Patent is hereby corrected as shown below:

In the Claims

Column 10, Line 9, Claim 1, delete "Operable" and insert -- operable --

Signed and Sealed this
Second Day of June, 2015

Michelle K. Lee

Michelle K. Lee
*Director of the United States Patent and Trademark Office*